US007281781B2

(12) United States Patent
Okawa

(10) Patent No.: US 7,281,781 B2
(45) Date of Patent: Oct. 16, 2007

(54) IMAGE FORMING APPARATUS AND POWER SUPPLY INTERRUPTION TIME MANAGEMENT METHOD

(75) Inventor: Kenichi Okawa, Hachioji (JP)

(73) Assignee: Olympus Corporation, Tokyo (JP)

( * ) Notice: Subject to any disclaimer, the term of this patent is extended or adjusted under 35 U.S.C. 154(b) by 292 days.

(21) Appl. No.: 10/942,250

(22) Filed: Sep. 15, 2004

(65) Prior Publication Data

US 2005/0062790 A1 Mar. 24, 2005

(30) Foreign Application Priority Data

Sep. 18, 2003 (JP) ..... 2003-326166

(51) Int. Cl.
*B41J 2/165* (2006.01)

(52) U.S. Cl. ..... 347/32; 347/35; 347/29

(58) Field of Classification Search ..... 347/3, 347/14, 22–35; 358/296
See application file for complete search history.

(56) References Cited

U.S. PATENT DOCUMENTS 5,115,250 A * 5/1992 Harmon et al. ..... 347/33
5,530,462 A * 6/1996 Takahashi et al. ..... 347/23
5,689,293 A * 11/1997 Hirano ..... 347/33
5,831,646 A * 11/1998 Kuronuma et al. ..... 347/30
6,095,632 A * 8/2000 Kobayashi et al. ..... 347/23
6,293,648 B1 * 9/2001 Anderson ..... 347/29
6,305,778 B1 * 10/2001 Kobayashi et al. ..... 347/30
6,431,680 B1 * 8/2002 Shinada ..... 347/19
6,578,945 B2 * 6/2003 Hashi et al. ..... 347/22
6,913,339 B2 * 7/2005 Uchida et al. ..... 347/29
7,128,389 B2 * 10/2006 Okamoto et al. ..... 347/29

FOREIGN PATENT DOCUMENTS

JP 2000-289215 A 10/2000

* cited by examiner

*Primary Examiner*—Shih-Wen Hsieh
(74) *Attorney, Agent, or Firm*—Frishauf, Holtz, Goodman & Chick, P.C.

(57) ABSTRACT

On detecting an operation instruction for interrupting a power supply, a maintenance mechanism and an ink head are moved with respect to each other in such a manner that the maintenance mechanism is disposed facing the ink head, and thereafter a power supplied to main body of an image forming apparatus is interrupted in a state in which droplets of ink liquids are received by a container of droplet receiving.

11 Claims, 8 Drawing Sheets

IMAGE FORMING APPARATUS AND POWER SUPPLY INTERRUPTION TIME MANAGEMENT METHOD

CROSS-REFERENCE TO RELATED APPLICATIONS

This application is based upon and claims the benefit of priority from prior Japanese Patent Application No. 2003-326166, filed Sep. 18, 2003, the entire contents of which are incorporated herein by reference.

BACKGROUND OF THE INVENTION

1. Field of the Invention

The present invention relates to an image forming apparatus of an ink jet system, which ejects an ink liquid from an ink head to form an image on an image forming medium, and a method of managing the apparatus at the time of interruption of power supply.

2. Description of the Background Art

A method of managing an image forming apparatus of an ink jet system at the time of interruption of power supply has been described, for example, in Jpn. Pat. Appln. KOKAI Publication No. 2000-289215. The following technique is described in the Jpn. Pat. Appln. KOKAI Publication No. 2000-289215. A power off timer is disposed which starts a timing operation and turns off a breaker after an elapse of a predetermined time, when a power switch is turned off. When the breaker is turned off, an operation power supply into the image forming apparatus is cut off.

The image forming apparatus sometimes executes an initial filling operation of filling an ink liquid into an ink channel extending to an image forming head (ink head) from an ink cartridge. A user sometimes turns off the power switch, while the initial filling operation is being executed. Even in this case, by the timing operation of the power off timer, the breaker is turned off upon lapse of the predetermined time from the moment the power switch is turned off. Therefore, the supply of the operation power of the image forming apparatus is continued until the initial filling operation ends. Accordingly, the initial filling operation is securely achieved.

In the image forming apparatus of the ink jet system, the ink liquid is ejected from the ink head to form the image onto the image forming medium. The ink liquid remains in opening tips of nozzle holes in the ink head even in a standby state in which any ink liquid is not ejected from the ink head. When the power supply of the image forming apparatus is interrupted in this state, the next power supply is waited for in a state in which the ink liquid remains in the opening tips of the nozzle holes in the ink head.

BRIEF SUMMARY OF THE INVENTION

According to a major aspect of the present invention, there is provided an image forming apparatus comprising: at least one ink head which ejects an ink liquid; a carriage on which the ink head is disposed; a maintenance mechanism having at least one container for receiving droplets; a conveyance mechanism which conveys an image forming medium; a moving/driving section which moves one or both of the carriage and the maintenance mechanism; an operating end portion which instructs power supply interruption at main body of the image forming apparatus main body; a control section which controls at least the moving/driving section in accordance with an instruction of the operating end portion; and a power supply interruption process section which move, the maintenance mechanism and the ink head with respect to each other in accordance with an instruction of the operating end portion in such a manner that the maintenance mechanism faces the ink head and interrupts power supply to the main body of the image forming apparatus in a state in which droplets of the ink liquids are received by the container for receiving droplets.

DETAILED DESCRIPTION OF THE INVENTION

A first embodiment of the present invention will be described hereinafter with reference to the drawings.

Figure 1:
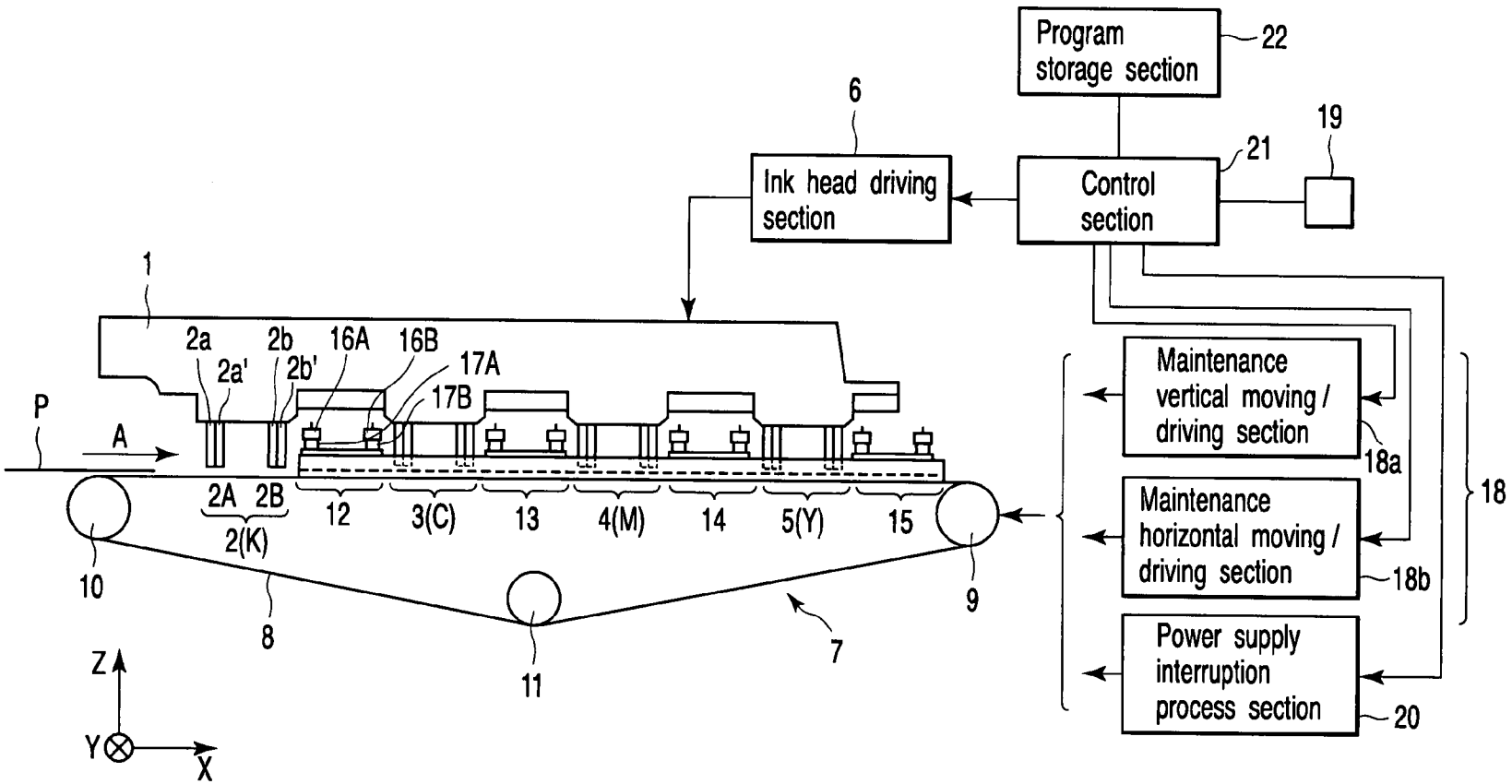
FIG. 1 is a diagram showing a first embodiment of an image forming apparatus of an ink jet system to which a power supply interruption time process method according to the present invention is applied.

FIG. 1 is a constitution diagram of an image forming apparatus of an ink jet system. Maintenance mechanisms 12 to 15 are disposed facing ink heads 2 to 5. The respective maintenance mechanisms 12 to 15 and the respective ink heads 2 to 5 move with respect to one another. That is, a carriage 1 is fixed/disposed. A conveyance mechanism 7 vertically moves. The respective maintenance mechanisms 12 to 15 vertically move in response to the vertical movement of the conveyance mechanism 7. The respective maintenance mechanisms 12 to 15 horizontally move.

A plurality of ink heads 2 to 5 are disposed at predetermined intervals in a lower portion of the carriage 1. The ink head 2 ejects a black (K) ink liquid. The ink head 3 ejects a cyan (C) ink liquid. The ink head 4 ejects a magenta (M) ink liquid. The ink head 5 ejects a yellow (Y) ink liquid.

An ink head driving section 6 drives the respective ink heads 2 to 5 in such a manner that the black (K), cyan (C), magenta (M), and yellow (Y) ink liquids are ejected from the ink heads 2 to 5.

In each of the ink heads 2 to 5, two ink head units are disposed with fellow the back of the ink heads. In each ink head unit, a plurality of nozzle holes for ejecting the ink liquids are arranged linearly (Y-axis direction). For example, the ink head 2 has ink head unit 2A, 2B constituting one set. The ink head unit 2A has two ink head units 2*a*, 2*a*'. In the ink head units 2*a*, 2*a*', a plurality of nozzle holes are arranged linearly (Y-axis direction). The respective ink head units 2*a*, 2*a*' are disposed with fellow the back of the ink heads.

The ink head unit 2B has two ink head units 2*b*, 2*b*'. In the ink head units 2*b*, 2*b*', a plurality of nozzle holes are arranged linearly (Y-axis direction). The respective ink head units 2*b*, 2*b*' are disposed with fellow the back of the ink heads. Each of the ink heads 3 to 5 has the same constitution as that of the ink head 2. The ink heads 3 to 5 are omitted to avoid complexity of the drawing.

The respective ink head units in each of the ink heads 2 to 5 are alternately arranged along an X-axis direction viewed in the drawing.

A belt platen 7 which is a conveyance mechanism is disposed under the respective ink heads 2 to 5.

The belt platen 7 carries an image forming medium P in an arrow A direction (X-axis direction) at the time of an image forming operation. The belt platen 7 has an endless belt 8, and three shafts 9 to 11 for extending the endless belt 8. The belt platen 7 rotates/drives, for example, the shaft 9 to move the belt 8. When the image forming medium P is laid on the moving belt 8, the image forming medium P is conveyed in the arrow A direction.

The respective maintenance mechanisms 12 to 15 perform maintaining, for example, cleaning of the ink heads 2 to 5. The maintenance mechanism 12 cleans the ink head 2 for black (K). The maintenance mechanism 13 cleans the ink head 3 for cyan (C). The maintenance mechanism 14 cleans the ink head 4 for magenta (M). The maintenance mechanism 15 cleans the ink head 5 for yellow (Y).

Each of the maintenance mechanisms 12 to 15 is disposed between the ink heads 2 to 5, respectively, at the time of the image forming operation.

The respective maintenance mechanisms 12 to 15 have suction nozzles which clean the ink heads 2 to 5, and caps disposed facing nozzle jet sections of the ink heads 2 to 5. For example, the maintenance mechanism 12 has suction nozzles 16A, 16B for cleaning the ink heads 2A, 2B; and caps 17A and 17B which are disposed facing the ink heads 2A and 2B each of which constitutes a part of a container for receiving droplets. The respective caps 17A and 17B have draining paths for discharging the ink liquids which dropped from the ink heads 2 to 5. The respective caps for the ink heads 3 to 5 are omitted to avoid the complexity of the drawing.

The respective maintenance mechanisms 12 to 15 are laid on the belt platen 7. Therefore, when the belt platen 7 moves up/down in a Z-axis direction, the maintenance mechanisms 12 to 15 also move up/down in the Z-axis direction in response to the moving-up/down of the platen. It is to be noted that a moving up/down range of each of the maintenance mechanisms 12 to 15 is regulated, for example, by a regulation member disposed on a frame of the image forming apparatus main body.

On detecting an operation instruction for interruption of a power in a power switch 19 which is an operation end portion, the moving/driving section 18 moves down the belt platen 7 and the maintenance mechanisms 12 to 15, moves the maintenance mechanisms 12 to 15 in a horizontal direction, and moves up the belt platen 7 and the maintenance mechanisms 12 to 15 to dispose the caps 17A, 17B and the like facing the ink heads 2 to 5. Concretely, the moving/driving section 18 has a maintenance vertical moving/driving section 18*a*, and a maintenance horizontal moving/driving section 18*b*.

The maintenance vertical moving/driving section 18*a* moves down the belt platen 7 and the maintenance mechanisms 12 to 15 in the Z-axis direction in accordance with a preset lowering distance in positioning the maintenance mechanisms 12 to 15 under the ink heads 2 to 5.

The respective ink heads 2 to 5 are fixed onto the carriage 1, and height positions are preset. The height positions of the respective maintenance mechanisms 12 to 15 in positioning the maintenance mechanisms 12 to 15 under the ink heads 2 to 5 are set beforehand. Therefore, the maintenance vertical moving/driving section 18*a* moves down in the Z-axis direction the belt platen 7 and the maintenance mechanisms 12 to 15 in accordance with the lowering distances preset based on the height positions of the maintenance mechanisms 12 to 15 and those of the ink heads 2 to 5 in positioning the maintenance mechanisms 12 to 15 under the ink heads 2 to 5.

Next, after moving the respective maintenance mechanisms 12 to 15 in the horizontal direction (X-axis direction) by the maintenance horizontal moving/driving section 18*b*, the maintenance mechanisms 12 to 15 are moved up in the Z-axis direction, the caps 17A, 17B and the like are disposed facing the nozzles of the ink heads 2 to 5, and the ink heads 2 to 5 are capped with the caps 17A, 17B and the like.

Lowered positions moving down the maintenance mechanisms 12 to 15 are preset. The height positions of the ink heads 2 to 5 are preset. Therefore, the maintenance vertical moving/driving section 18*a* moves up the belt platen 7 and the maintenance mechanisms 12 to 15 in the Z-axis direction in accordance with raising distances preset based on the lowered positions in moving down the maintenance mechanisms 12 to 15 and the height positions of the ink heads 2 to 5. Accordingly, the ink heads 2 to 5 are capped with the caps 17A, 17B and the like.

After the belt platen 7 and the maintenance mechanisms 12 to 15 move down, the maintenance horizontal moving/driving section 18*b* moves the maintenance mechanisms 12 to 15 in the horizontal direction (X-axis direction), and the caps 17A, 17B and the like are disposed right under the ink heads 2 to 5.

The X-axis direction is a direction crossing an arrangement direction of the respective ink heads 2 to 5.

The position of each of the maintenance mechanisms 12 to 15 disposed between the ink heads 2 to 5 in the X-axis direction at the time of the image forming operation is preset. The position right under each of the ink heads 2 to 5 in the X-axis direction is also preset. Therefore, the maintenance horizontal moving/driving section 18*b* moves the maintenance mechanisms 12 to 15 in the horizontal direction, that is, a left direction on the drawing in accordance with preset horizontal distances based on the positions of the maintenance mechanisms 12 to 15 disposed between the ink heads 2 to 5 at the time of the image forming operation and the positions right under the ink heads 2 to 5. Accordingly, the maintenance mechanisms 12 to 15 are positioned right under the ink heads 2 to 5.

A power supply interruption process section 20 interrupts a power supplied to an image forming apparatus main body of an ink jet system, that is, a system power supply, when the ink heads 2 to 5 are capped with the caps 17A, 17B and the like.

A control section 21 has a CPU, a data memory, an input/output port, a data bus, a control bus and the like. The control section 21 is connected to the power switch 19 which is an operation end portion. The control section 21 is capable of reading a stored program with respect to a program storage section 22. A program at the time of the power supply interruption is stored in the program storage section 22.

The control section 21 controls a series of image forming operation in the image forming apparatus of the ink jet system. On receiving the operation instruction of the power supply interruption from the power switch 19, the control section 21 issues commands for the power supply interruption process to the maintenance vertical moving/driving section 18*a*, maintenance horizontal moving/driving section 18*b*, and power supply interruption process section 20 in accordance with the program at the time of the power supply interruption, stored in the program storage section 22.

The program at the time of the power supply interruption has first to fourth process steps. In the first process step, the operation instruction for interrupting the power supply of the image forming apparatus of the ink jet system is detected from the power switch 19.

In the second process step, after moving down the belt platen 7 and the maintenance mechanisms 12 to 15 in the Z-axis direction, the maintenance mechanisms 12 to 15 are moved in the X-axis direction, and moved right under the ink heads 2 to 5.

In the third process step, the maintenance mechanisms 12 to 15 are moved up in the Z-axis direction, and the caps 17A, 17B and the like disposed in the maintenance mechanisms 12 to 15 are disposed facing the ink heads 2 to 5.

In the fourth process step, after disposing the caps 17A, 17B and the like facing the jet nozzle sections of the ink heads 2 to 5, the interruption process of the system power supply of the image forming apparatus of the ink jet system is performed.

Therefore, on detecting the operation instruction of the power supply interruption from the power switch 19, the control section 21 issues an instruction to move the belt platen 7 and the maintenance mechanisms 12 to 15 and to move the maintenance mechanisms 12 to 15 right under the ink heads 2 to 5 with respect to the maintenance vertical moving/driving section 18*a* and the maintenance horizontal moving/driving section 18*b*. Next, the control section issues an instruction to move up the maintenance mechanisms 12 to 15 and to dispose the caps 17A, 17B and the like of the maintenance mechanisms 12 to 15 facing the ink heads 2 to 5 with respect to the maintenance vertical moving/driving section 18*a*. Next, after capping the respective ink heads 2 to 5 with the caps 17A, 17B and the like, the control section performs the interruption process of the system power supply of the image forming apparatus of the ink jet system.

The control section 21 has a timer for exclusive use in interruption. At a preset time $t_0$ after timing is started, the timer for exclusive use in interruption issues a time-up signal at the time $t_0$. On detecting the operation instruction in the power supply interruption of the power switch 19, the control section 21 starts a timing operation of the timer for exclusive use in interruption. The control section 21 issues a command to perform the process of the power supply interruption with respect to the power supply interruption process section 20 only in a case where the operation instruction is continuously detected even after time-up of the timer for exclusive use in interruption.

Accordingly, when the power switch 19 is brought back into an energized state before the time-up of the timer for exclusive use in interruption, the control section 21 does not execute the interruption process of the power supply. Therefore, even when the power switch 19 is turned off by mistake, the power supply is not interrupted.

Figure 2:
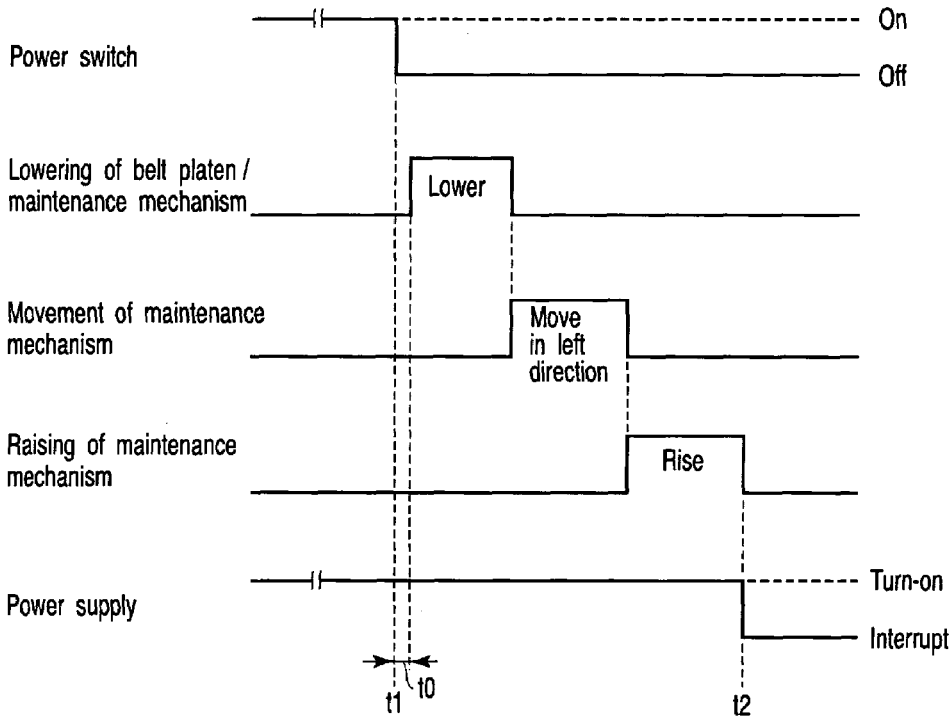
FIG. 2 is a timing chart of a power supply interruption time process in the apparatus.

Next, a process in the apparatus constituted as described above at the time of power supply interruption will be described with reference to a power supply interruption time process timing chart shown in FIG. 2.

Figure 3:
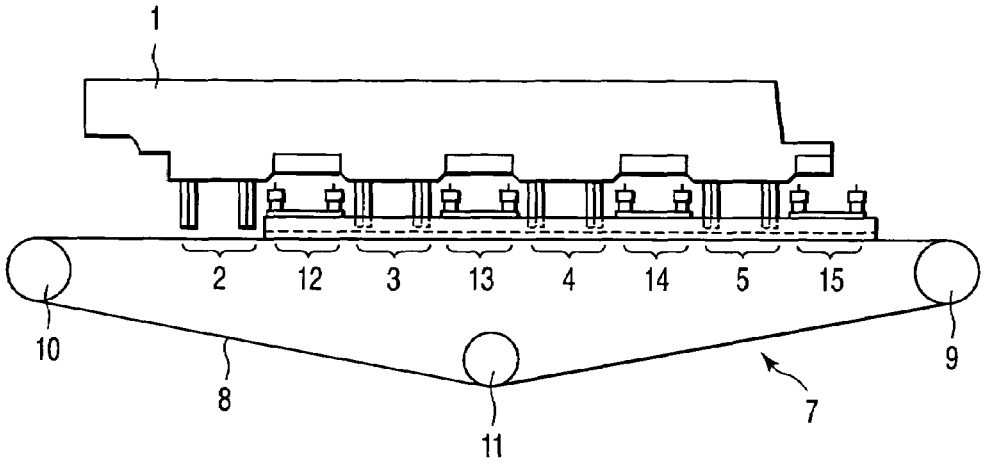
FIG. 3 is a diagram showing an image forming operation in the apparatus or a standby state of a maintenance mechanism at the time of the image forming operation.

When the power switch 19 is turned on, the power is supplied to the main body of the image forming apparatus. Accordingly, the image forming apparatus is in a state of the image forming operation onto the image forming medium P or a standby state for the image forming operation. In this state, the belt platen 7 is in a raised position in the Z-axis direction as shown in FIG. 3. The respective maintenance mechanisms 12 to 15 are in the raised positions in the Z-axis direction in accordance with the raised position of the belt platen 7. Accordingly, the respective maintenance mechanisms 12 to 15 are housed/disposed between the ink heads 2 to 5, respectively.

The image forming operation is performed as follows. The belt platen 7 conveys the image forming medium P in the arrow A direction (X-axis direction). When the image forming medium P is conveyed under the respective ink heads 2 to 5, for example, the ink head 2 ejects the black (K) ink liquid. The ink head 3 ejects the cyan (C) ink liquid. The ink head 4 ejects the magenta (M) ink liquid. The ink head 5 ejects the yellow (Y) ink liquid. The respective KCMY ink liquids ejected from the ink heads 2 to 5 are shot on the surface of the image forming medium P. Accordingly, an image is formed on the surface of the image forming medium P.

When the power switch 19 issues the operation instruction at time $t_1$ of the power supply interruption the control section 21 starts an operation for interrupting the power supply of the image forming apparatus of the ink jet system from the power switch 19 after an elapse of the time $t_0$ from the time $t_1$. That is, the control section 21 issues a lowering instruction to the maintenance vertical moving/driving section 18*a* upon lapse of the time $t_0$ from the time $t_1$.

Figure 4:
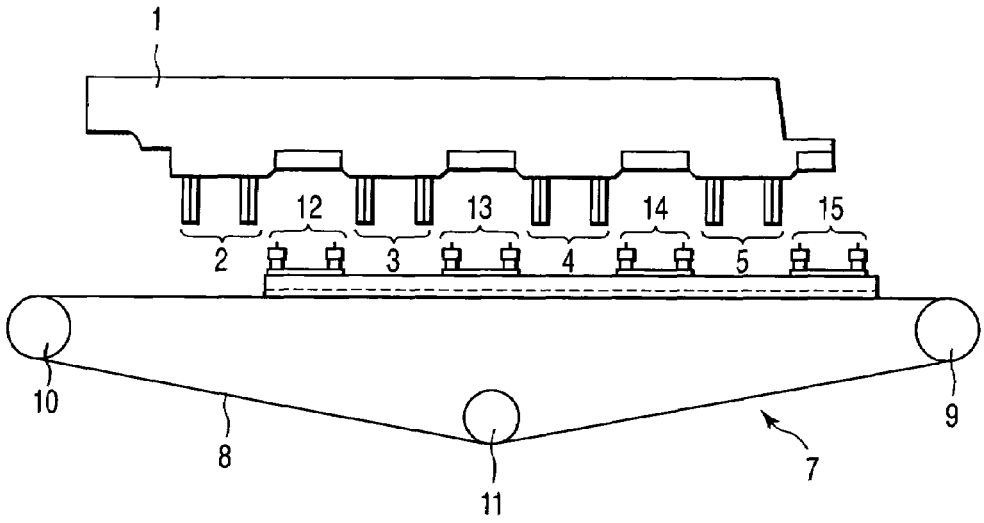
FIG. 4 is a diagram showing that a belt platen and the maintenance mechanism moves downwards in the apparatus.

On receiving the lowering instruction issued from the control section 21, the maintenance vertical moving/driving section 18*a* moves down the belt platen 7 and the maintenance mechanisms 12 to 15 in the Z-axis direction in accordance with preset lowering distances. In this case, the belt platen 7 moves down in accordance with the preset lowering distance. When the belt platen 7 moves down, the maintenance mechanisms 12 to 15 move down in the Z-axis direction in response to the movement as shown in FIG. 4. Accordingly, the suction nozzles 16A, 16B and the like of the maintenance mechanisms 12 to 15 are positioned under the nozzle holes of the ink heads 2 to 5.

Figure 5:
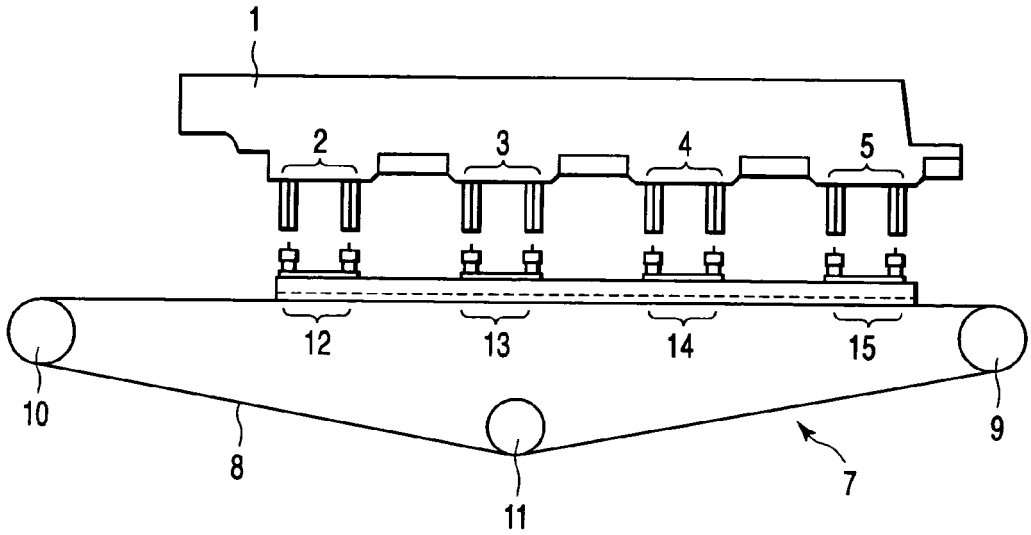
FIG. 5 is a diagram showing movement of the maintenance mechanism right under ink heads in the apparatus.

Next, at the end of the lowering of the belt platen 7 and the maintenance mechanisms 12 to 15, the control section 21 issues a movement command to the maintenance horizontal moving/driving section 18*b* to move the maintenance mechanisms 12 to 15 in the left direction on the drawing as shown in FIGS. 4 and 5 and to move them right under the ink heads 2 to 5.

The maintenance horizontal moving/driving section 18*b* moves the maintenance mechanisms 12 to 15 in the left direction on the drawing in accordance with a horizontal distance preset based on the positions of the maintenance mechanisms 12 to 15 disposed between the ink heads 2 to 5 and the positions right under the ink heads 2 to 5 at the time of the image forming operation. Accordingly, the respective maintenance mechanisms 12 to 15 are positioned right under the ink heads 2 to 5.

Figure 6:
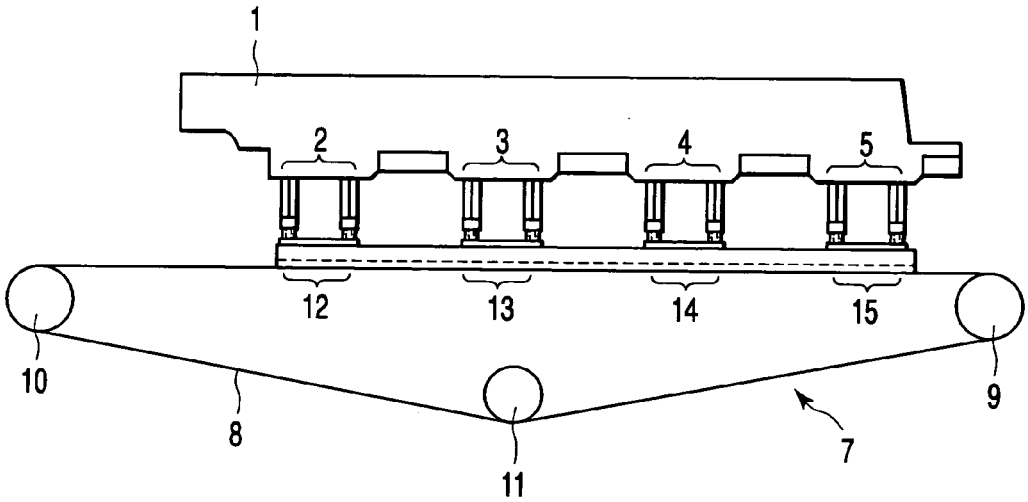
FIG. 6 is a diagram showing that the respective ink heads are containing into the caps of the apparatus.

Next, the control section 21 issues a capping instruction to the maintenance vertical moving/driving section 18*a* at the end of the horizontal movements of the maintenance mechanisms 12 to 15. On receiving the capping instruction issued from the control section 21, the maintenance vertical moving/driving section 18*a* moves up the maintenance mechanisms 12 to 15 in the Z-axis direction in accordance with the preset raising distance as shown in FIG. 6.

Figure 7:
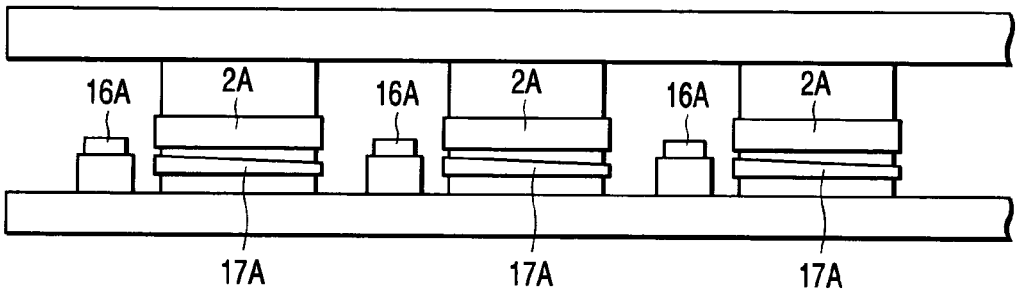
FIG. 7 is a diagram showing that the respective ink heads are containing into the caps of the apparatus.

When the maintenance mechanisms 12 to 15 are moved up, the caps 17A, 17B and the like are disposed facing the ink heads 2 to 5. The caps 17A, 17B caps the ink heads 2 to 5. FIG. 7 shows a side view in a state in which the ink heads 2 to 5 are capped with the caps 17A, 17B and the like.

When the respective ink heads 2 to 5 are capped with the caps 17A, 17B and the like in this manner, the control section 21 issues a power supply interruption instruction to the power supply interruption process section 20. On receiving the power supply interruption instruction from the control section 21, the power supply interruption process section 20 interrupts the system power supply of the image forming apparatus main body of the ink jet system. In this manner, the system power supply of the image forming apparatus is interrupted at a time $t_2$.

As described above, according to the first embodiment, when the operation instruction for interrupting the system power supply of the image forming apparatus of the ink jet system is detected, the belt platen 7 and the maintenance mechanisms 12 to 15 are moved down, and next the maintenance mechanisms 12 to 15 are moved right under the ink heads 2 to 5. Next, after moving up the respective maintenance mechanisms 12 to 15, and capping the ink heads 2 to 5 with the caps 17A, 17B and the like, the system power supply of the image forming apparatus of the ink jet system is interrupted.

Even with the operation instruction for interrupting the system power supply at the time of the image forming operation onto the image forming medium P by the image forming apparatus of the ink jet system or in the standby state of the image forming operation, after capping the nozzles of the ink heads 2 to 5 with the caps 17A, 17B and the like, the system power supply can be interrupted. Accordingly, the system power supply is not interrupted in a state in which the ink heads 2 to 5 are left above the belt platen 7.

At the time of the image forming operation or in the standby state for the image forming operation, the ink liquids remain in the opening tips of the nozzle holes of the ink heads 2 to 5. When the system power supply is interrupted in this state, the ink liquids remaining in the opening tips of the nozzle holes of the ink heads 2 to 5 sometimes drop from the nozzle holes. Since the droplets of the ink liquids which have dropped from the nozzle holes are received by the caps 17A, 17B and the like, the belt platen 7 can be prevented from being soiled by the ink liquids.

Since the caps 17A, 17B and the like disposed in the maintenance mechanisms 12 to 15 are used, it is not necessary to newly dispose the caps 17A, 17B and the like for receiving the droplets of the ink liquids dropped from the nozzle holes of the ink heads 2 to 5.

The vertical movements of the maintenance mechanisms 12 to 15 may be modified as follows. For example, the maintenance mechanisms 12 to 15 have base frames. The main body of the image forming apparatus has a frame. A support member supports the maintenance mechanisms 12 to 15 in such a manner that the mechanisms are vertically movable with respect to the main body of the image forming apparatus. That is, one end portion of the support member is connected to the back surface of the base frame of each of the maintenance mechanisms 12 to 15. The other end portion of the support member supports the mechanism vertically movably with respect to the frame of the main body of the image forming apparatus. One motor is disposed in the support member. The support member is driven by the motor to move the maintenance mechanisms 12 to 15 in a vertical direction. Accordingly, the respective maintenance mechanisms 12 to 15 move vertically with respect to the main body of the image forming apparatus.

As described above, according to the first embodiment, after completing the relative movements of the maintenance mechanisms 12 to 15 and the ink heads 2 to 5 in facing arrangements in accordance with the power supply interruption operation instruction of the power switch 19 which is the operation end portion (capping the ink heads 2 to 5 with the caps 17A, 17B), the power supply interruption process of the main body of the image forming apparatus is performed.

Next, a second embodiment of the present invention will be described with reference to the drawings.

Figure 8:
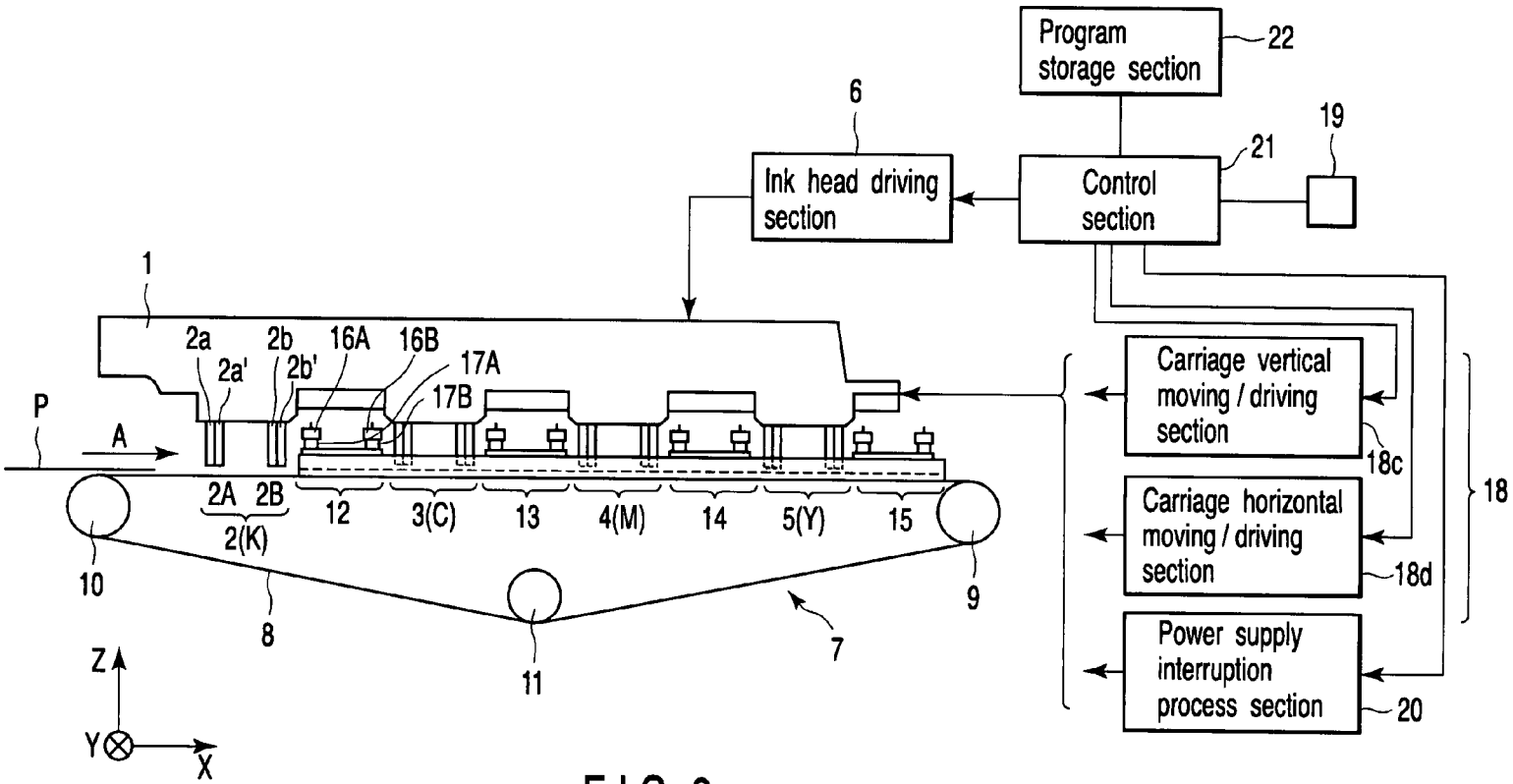
FIG. 8 is a constitution diagram showing a second embodiment of the image forming apparatus of the ink jet system to which a process method at the time of the power supply interruption according to the present invention is applied.

FIG. 8 is a constitution diagram showing the image forming apparatus of the ink jet system. In the second embodiment, the same parts as those of the first embodiment and modification are denoted with the same reference numerals, and the description of the same function and effect as those of the first embodiment is omitted.

In the second embodiment, a carriage 1 vertically and horizontally moves with respect to maintenance mechanisms 12 to 15 positioned between ink heads 2 to 5.

The carriage 1 is supported by the support member in such a manner as to be movable vertically and horizontally with respect to the main body of the image forming apparatus. One end portion of the support member is connected to the back surface of the carriage 1. The other end portion of the support member supports the carriage vertically and horizontally movably with respect to the frame of the main body of the image forming apparatus. The support member is disposed with, for example, two of first and second motors. The support member is driven, for example, by the first motor to move the carriage 1 in a vertical direction. The support member is driven, for example, by the second motor to move the carriage 1 in a horizontal direction. Accordingly, the carriage 1 vertically and horizontally moves with respect to the main body of the image forming apparatus.

A carriage vertical moving/driving section 18*c* issues a command to move the carriage 1 in the vertical direction with respect to the first motor.

A carriage horizontal moving/driving section 18*d* issues a command to move the carriage 1 in the horizontal direction with respect to the second motor.

After moving up, the carriage 1 horizontally moves in a right direction on FIG. 8. Thereafter, the carriage 1 moves down. Accordingly, relative movements of the maintenance mechanisms 12 to 15 and the ink heads 2 to 5 in facing arrangement are completed.

As described above, according to the second embodiment, after the relative movements of the maintenance mechanisms 12 to 15 and the ink heads 2 to 5 in the facing arrangement are completed (the ink heads 2 to 5 are capped with the caps 17A, 17B), a power supply interruption process of the main body of an image forming apparatus is performed by a power supply interruption operation instruction of a power switch 19 which is an operation end portion.

Next, a third embodiment of the present invention will be described with reference to the drawings.

Figure 9:
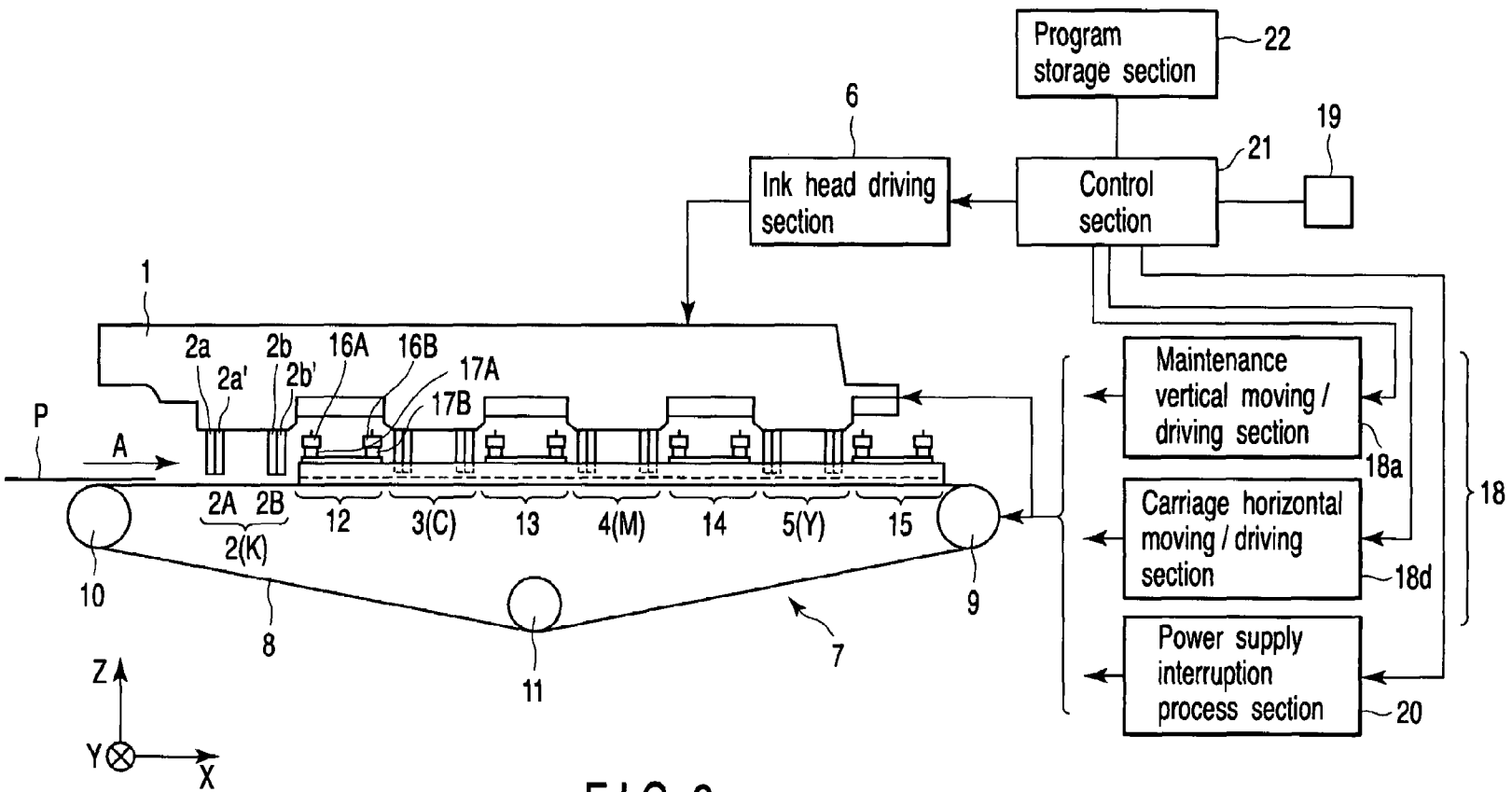
FIG. 9 is a diagram showing a third embodiment of the image forming apparatus of the ink jet system, to which a method of interrupting the power supply according to the present invention is applied.

FIG. 9 is a constitution diagram of the image forming apparatus of the ink jet system. In the third embodiment, the same parts as those of the first embodiment, modification, and second embodiment are denoted with the same reference numerals, and the description of the same function and effect as those of the first embodiment, modification, and second embodiment is omitted.

In the third embodiment, as shown in FIG. 9, maintenance mechanisms 12 to 15 positioned between ink heads 2 to 5 vertically move, and the carriage 1 horizontally moves.

The maintenance mechanisms 12 to 15 move vertically with respect to the main body of an image forming apparatus by a support member. One end portion of the support member is connected to the back surface of a base frame of each of the maintenance mechanisms 12 to 15. The other end portion of the support member supports the maintenance mechanisms vertically movably with respect to the frame of the main body of the image forming apparatus. The support member is disposed with, for example, one of third motor. The support member is driven, for example, by the motor to move the maintenance mechanisms 12 to 15 in a vertical direction.

The carriage 1 is supported horizontally movably with respect to the main body of the image forming apparatus by the support member. One end portion of the support member is connected to the back surface of the carriage 1. The other end portion of the support member supports the carriage horizontally movably with respect to the frame of the main body of the image forming apparatus. For example, the support member is disposed with one of fourth motor. For example, the support member is driven by the motor to move the carriage 1 in a horizontal direction. Accordingly, the carriage 1 moves horizontally with respect to the main body of the image forming apparatus.

A maintenance vertical moving/driving section 18*a* issues a command to move the maintenance mechanisms 12 to 15 in a vertical direction with respect to the third motor.

A carriage horizontal moving/driving section 18*d* issues a command to move the carriage 1 in the horizontal direction with respect to the fourth motor.

The respective maintenance mechanisms 12 to 15 move down. Next, the carriage 1 horizontally moves in a right direction on FIG. 9. Thereafter, the maintenance mechanisms 12 to 15 move up. Accordingly, relative movements of the maintenance mechanisms 12 to 15 and the ink heads 2 to 5 in facing movements are completed.

The maintenance mechanisms 12 to 15 may be moved up/down by the vertical movement of a conveyance mechanism 7 in the same manner as in the first embodiment.

As described above, according to the third embodiment, after the relative movements of the maintenance mechanisms 12 to 15 and the ink heads 2 to 5 in the facing movements are completed (the ink heads 2 to 5 are capped with the caps 17A, 17B), the power supply interruption process of the image forming apparatus is performed in accordance with a power supply interruption operation instruction of a power switch 19 which is an operation end portion.

Next, a fourth embodiment of the present invention will be described with reference to the drawings.

Figure 10:
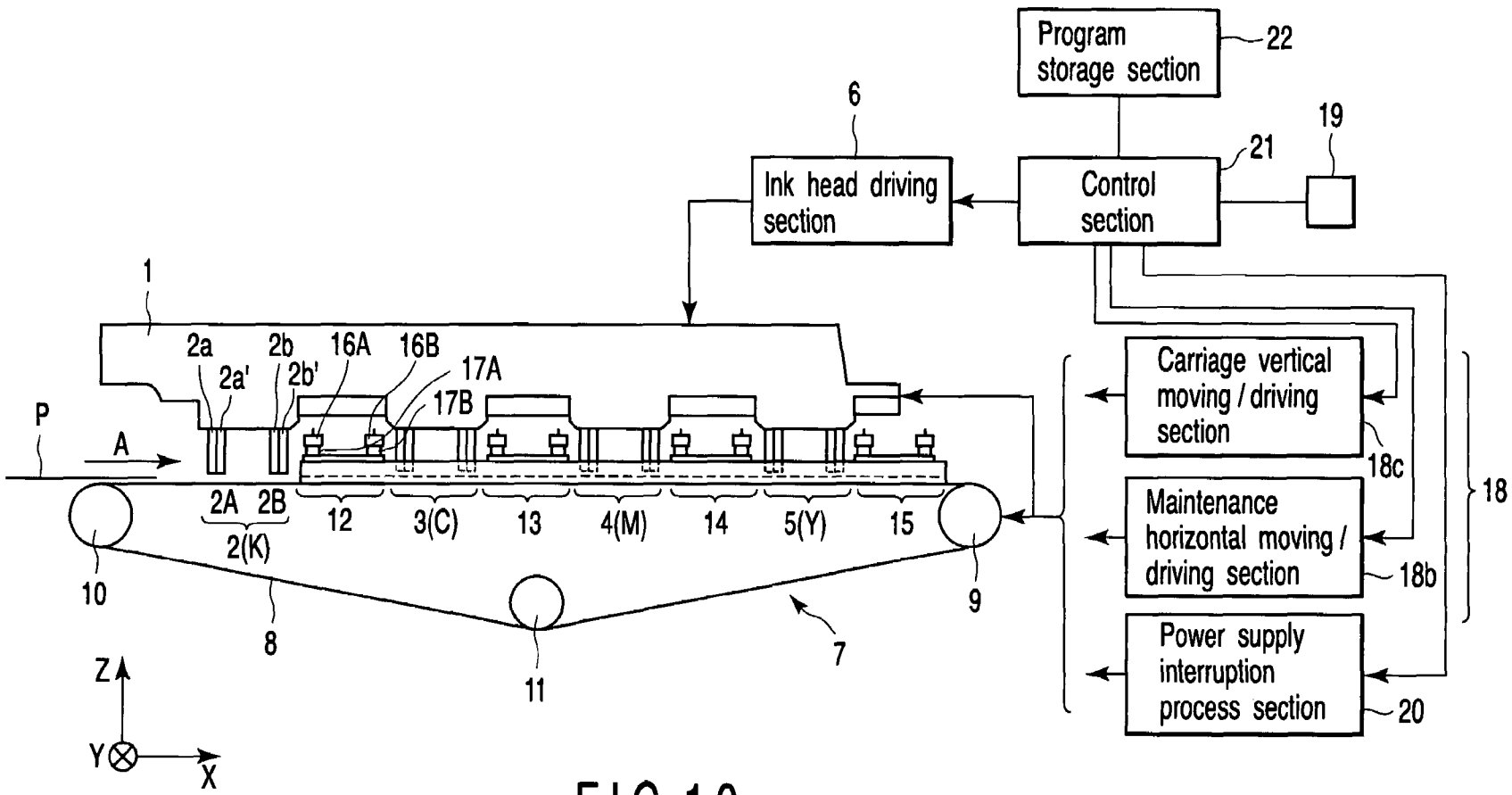
FIG. 10 is a constitution diagram showing a fourth embodiment of the image forming apparatus of the ink jet system to which the power supply interruption time process method according to the present invention is applied.

FIG. 10 is a constitution diagram of the image forming apparatus of the ink jet system. It is to be noted that in the fourth embodiment, the same parts as those of the first embodiment, modification, second embodiment, third embodiment, and modification are denoted with the same reference numerals, and the description of the same function and effect as those of the first embodiment, modification, second embodiment, third embodiment, and modification is omitted.

In the fourth embodiment, as shown in FIG. 10, a carriage 1 vertically moves, and maintenance mechanisms 12 to 15 positioned between ink heads 2 to 5, respectively, horizontally move.

The carriage 1 is supported vertically movably with respect to the main body of an image forming apparatus by a support member. One end portion of the support member is connected to the back surface of the carriage 1. The other end portion of the support member supports the carriage horizontally movably with respect to the frame of the main body of the image forming apparatus. The support member is provided with, for example, one of fifth motor. The support member is driven, for example, by the fifth motor to move the carriage 1 in a vertical direction. Accordingly, the carriage 1 vertically moves with respect to the main body of the image forming apparatus.

The respective maintenance mechanisms 12 to 15 are supported horizontally movably with respect to the main body of the image forming apparatus by the support member. One end portion of the support member is connected to the back surface of a base frame of each of the maintenance mechanisms 12 to 15. The other end portion of the support member supports the mechanisms horizontally movably with respect to the main body of the frame of the image forming apparatus. For example, the support member is provided with one of sixth motor. For example, the support member is driven by the sixth motor to move the maintenance mechanisms 12 to 15 in a horizontal direction. Accordingly, the respective maintenance mechanisms 12 to 15 move horizontally with respect to the main body of the image forming apparatus.

A carriage vertical moving/driving section 18*c* issues a command to move the carriage 1 in a vertical direction with respect to the fourth motor.

A maintenance horizontal moving/driving section 18*b* issues a command to move the maintenance mechanisms 12 to 15 in the horizontal direction with respect to the sixth motor.

The carriage 1 moves up. Thereafter, the respective maintenance mechanisms 12 to 15 horizontally move in a left direction on FIG. 10. Thereafter, the carriage 1 moves down. Accordingly, relative movements of the maintenance mechanisms 12 to 15 and the ink heads 2 to 5 in facing movements are completed.

As described above, according to the fourth embodiment, after the relative movements of the maintenance mechanisms 12 to 15 and the ink heads 2 to 5 in the facing movements are completed (the ink heads 2 to 5 are capped with the caps 17A, 17B), the power supply interruption process of the image forming apparatus is performed in accordance with a power supply interruption operation instruction of a power switch 19 which is an operation end portion.

The present invention is not limited to the first to fourth embodiments and the respective modifications, and may be modified as follows.

The ink heads 2 to 5 are capped with the caps 17A, 17B and the like, but the present invention is not limited to this, and the caps may be disposed facing the ink heads at predetermined intervals right under the ink heads.

Moreover, the caps 17A, 17B and the like may be disposed in positions where the droplets of the ink liquids dropped from the ink heads 2 to 5 can be received.

Furthermore, the caps 17A, 17B and the like may have any configurations as long as the caps are containers capable of receiving the droplets of the ink liquids dropped from the ink heads 2 to 5.

Additionally, the conveyance mechanism of the image forming medium P is not limited to the belt platen 7, and another conveyance mechanism may be applied.

Moreover, the power switch 19 may be a switch which performs contacting/opening between contacts, or a switch of a touch panel system, displayed on a display screen.

Furthermore, a timing to interrupt the system power supply is not limited to a time $t_2$ when the ink heads 2 to 5 are capped with the caps 17A, 17B and the like, and may be a time $t_2$ or subsequent times.

What is claimed is:

1. An image forming apparatus comprising:

at least one ink head which ejects ink;

a carriage on which the ink head is disposed;

a maintenance mechanism including at least one container for receiving droplets;

a moving/driving section which moves the maintenance mechanism;

an operating end portion which instructs power supply interruption to a main body of the image forming apparatus;

a control section which controls at least the moving/driving section in accordance with an instruction regarding power supply interruption by the operating end portion, so as to move the maintenance mechanism down, in a horizontal direction, and up so as to position the at least one container for receiving droplets at a position to receive droplets of the ink from the at least one ink head; and a power supply interruption process section which, interrupts power supply to the main body of the image forming apparatus when the at least one container for receiving droplets has been positioned at the position to receive droplets of the ink from the at least one ink head by the movement of the maintenance mechanism.

2. The image forming apparatus according to claim 1, wherein on detecting the instruction for power supply interruption from the operating end portion, the control section issues a command to the moving/driving section to move the maintenance mechanism and the ink head with respect to each other to position the maintenance mechanism to face the ink head, and after confirming that the at least one container for receiving droplets is at the position to receive droplets of the ink from the at least one ink head, the control section issues a command to the power supply interruption process section to interrupt the power supply of the image forming apparatus main body, so that a power supply interruption process is performed with respect to the image forming apparatus main body.

3. The image forming apparatus according to claim 1, wherein a quantity of the at least one ink head is equal to a quantity of the at least one container for receiving droplets.

4. The image forming apparatus according to claim 1, wherein the container for receiving droplets comprises a cap.

5. The image forming apparatus according to claim 1, wherein the moving/driving section comprises:

a vertical moving/driving section which vertically moves the maintenance mechanism; and a horizontal moving/driving section which moves the maintenance mechanism in a horizontal direction.

6. The image forming apparatus according to claim 1, wherein during image forming the maintenance mechanism is positioned to be adjacent to the ink head.

7. The image forming apparatus according to claim 1, wherein a moving range of the maintenance mechanism is regulated by a regulation member disposed on a frame of the main body of the image forming apparatus.

8. The image forming apparatus according to claim 1, further comprising:

a program storage section which stores a power supply interruption program that is executed to interrupt the power supply to the main body of the image forming apparatus, wherein the control section controls the power supply interruption process section to interrupt the power supply to the main body of the image forming apparatus when the at least one container for receiving droplets is at the position to receive droplets of the ink from the at least one ink head based on the power supply interruption program stored in the program storage section.

9. The image forming apparatus according to claim 1, further comprising a conveyance mechanism which conveys an image forming medium, wherein the moving/driving section moves the maintenance mechanism down in accordance with moving-down of the conveyance mechanism, and moves the maintenance mechanism up in accordance with moving-up of the conveyance mechanism.

10. A method of managing power supply interruption of an image forming apparatus comprising at least one ink head which ejects ink, a carriage on which the ink head is disposed, a maintenance mechanism including at least one container for receiving droplets, a moving/driving section which moves the maintenance mechanism, an operating end portion which instructs interruption of power supply to a main body of the image forming apparatus, and a control section which controls at least the moving/driving section to move the maintenance mechanism, said method comprising:

controlling the moving/driving section by the control section, in response to an operating instruction given by the operating end portion to interrupt the power supply to the main body, to move the maintenance mechanism down, in a horizontal direction, and up to a position where it faces the at least one ink head so as to position the at least one container for receiving droplets at a position to receive droplets of ink from the at least one ink head; and interrupting the power supply to the main body when the at least one container for receiving droplets has been positioned at the position to receive droplets of the ink from the at least one ink head by the movement of the maintenance mechanism.

11. The method of managing power supply interruption of the image forming apparatus according to claim 10, wherein the image forming apparatus further comprises a conveyance mechanism which conveys an image forming medium, and the moving/driving section moves the maintenance mechanism down in accordance with moving-down of the conveyance mechanism, and moves the maintenance mechanism up in accordance with moving-up of the conveyance mechanism, as the control section controls the moving/driving section in response to the operating instruction given by the operating end portion to interrupt the power supply to the main body.

* * * * *